US007150296B2

(12) United States Patent
Vanderjeugt et al.

(10) Patent No.: US 7,150,296 B2
(45) Date of Patent: Dec. 19, 2006

(54) DEVICE FOR ATTACHING AND GUIDING ONE OR SEVERAL PULLEY CORDS OF A JACQUARD MACHINE

(75) Inventors: Bram Vanderjeugt, Ieper (BE); Benedict Hanssens, Marke (BE)

(73) Assignee: N. V. Michel Van de Wiele, Kortrijk/Marke (BE)

( * ) Notice: Subject to any disclaimer, the term of this patent is extended or adjusted under 35 U.S.C. 154(b) by 55 days.

(21) Appl. No.: 10/849,490

(22) Filed: May 20, 2004

(65) Prior Publication Data

US 2004/0244861 A1 Dec. 9, 2004

(30) Foreign Application Priority Data

May 20, 2003 (BE) ..... 2003/0308

(51) Int. Cl.
*D03C 3/00* (2006.01)

(52) U.S. Cl. ..... 139/59

(58) Field of Classification Search ..... 139/55.1, 139/59, 65, 62–63, 68, 455, 85
See application file for complete search history.

(56) References Cited

U.S. PATENT DOCUMENTS 5,353,846 A * 10/1994 Gheysen et al. ..... 139/65
5,678,612 A * 10/1997 Derudder et al. ..... 139/65
5,862,836 A * 1/1999 Himmelstoss ..... 139/65

FOREIGN PATENT DOCUMENTS

| | | | |
|---|---|---|---|
| BE | 1005823 | A3 | 2/1994 |
| EP | 421370 | A1 * | 4/1991 |
| EP | 0801161 | | 10/1997 |
| EP | 0839937 | | 5/1998 |

* cited by examiner

*Primary Examiner*—Gary L. Welch
*Assistant Examiner*—Andrew W. Sutton
(74) *Attorney, Agent, or Firm*—James Creighton Wray

(57) ABSTRACT

The invention relates to a device for attaching and guiding one or several pulley cords (9, 10) of a Jacquard machine, comprising one or several pulley blocks (11, 15, 17), each pulley block (11, 15, 17) being provided with at least two pulley wheels (6, 7) around which one or several pulley cords (9, 10) are passed and being provided with one or several pulley block guiding grooves (14) for guiding one or several guiding elements (13) which are designed to maintain the exact position of the one or several pulley blocks (11, 15, 17), the said pulley block guiding grooves (14) being provided outside the space between the said pulley wheels (6, 7).

7 Claims, 1 Drawing Sheet

PRIOR ART
Fig 1
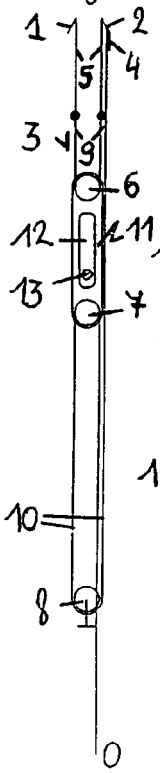
Fig 2
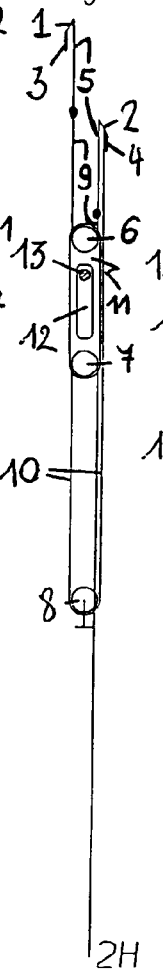
Fig 3
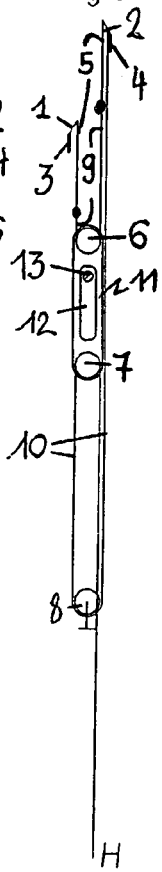
Fig 4
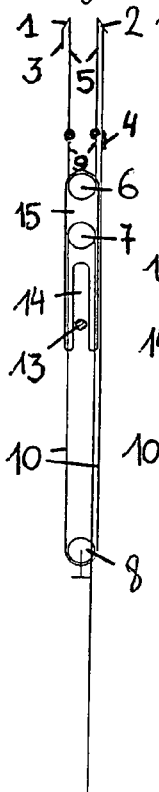
Fig 5
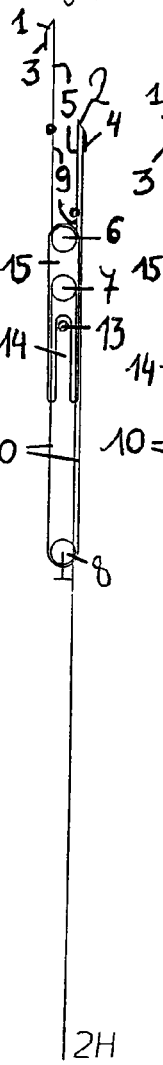
Fig 6
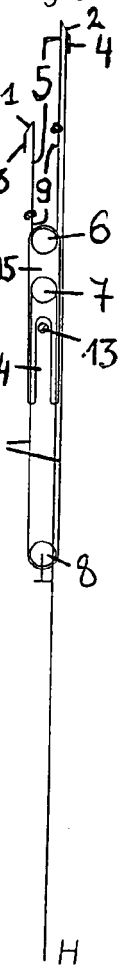
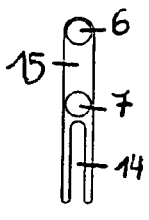
Fig 7
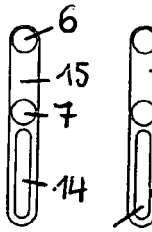
Fig 8
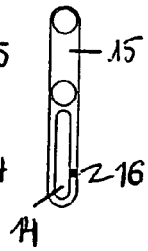
Fig 9
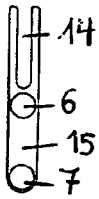
Fig 10
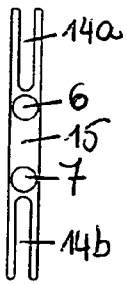
Fig 11
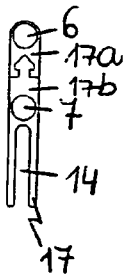
Fig 12

DEVICE FOR ATTACHING AND GUIDING ONE OR SEVERAL PULLEY CORDS OF A JACQUARD MACHINE

This application claims the benefit of Belgian Application No. 2003/0308 filed May 20, 2003.

BACKGROUND OF THE INVENTION

The invention relates to a device for attaching and guiding one or several pulley cords of a Jacquard machine, comprising one or several pulley blocks, each pulley block being provided with at least two pulley wheels around which one or several pulley cords are passed and being provided with one or several pulley blocks guiding grooves for guiding one or several guiding elements which are designed to maintain the exact position of the one or several tackle blocks.

In order to bring the warp yarns and/or pile yarns of a weaving machine in their exact positions in order to realize, in combination with the weft yarns, the weave desired having the pattern desired, Jacquard machines are used. This is the case for flat weaving machines in which warp yarns are brought into their exact positions, in order to insert the weft to form, together with the weft yarns, the weave and figure desired. This is likewise the case for face-to-face weaving machines, in which pile yarns are brought into their exact positions in order to insert the weft, so that the pile warp yarns, together with the backing warp yarns and the weft yarns, should form the figure and weave desired. Similar Jacquard machines consist of at least two rows of hooks and of at least two blades each of which are permanently moving up and down in opposite phase with respect to a row of hooks and which may take along or not take along each of the hooks of that row. Taking along the hooks or not is controlled by selection elements, which, in the upper or lower position of the hooks of the Jacquard machine (dependent on their design), will retain the hooks for the duration of one or several cycles. Two hooks being directly opposed, which each are moved by a blade, the two said blades moving in opposite phase, constitute a complementary set of hooks. Hooks of one or two complementary sets of hooks, being selected or not, will take up different positions. By taking up these different positions these co-operating hooks will bring those warp yarns at the height desired to realize a fabric with a pattern, by a co-operation of these hooks with pulley wheels and inversing pulley wheels imposed by the interconnection, by means of the pulley cords passed round these pulley wheels and reversing pulley wheels, and because of these pulley cords being connected to one or several warp yarns (by means of a harness cord).

The Jacquard machines are built as compact as possible in order to be able to built in as many hooks as possible with additional selection elements and pulley block systems on a certain surface. The selection elements are made smaller and smaller and the pulley block systems have to follow this miniaturization. A pulley block device requires a regular maintenance and survey, for instance, to replace defective or worn out or broken pulley cords or pulley blocks. It is therefore necessary to find one's way among the other pulley systems and pulley cords in order to be able to replace the defective or worn out pulley block or cord. In doing so, there is a great risk that because of this manual operation a pulley block might be twisted through 180° with respect to the vertical axis (direction of the pulley cords) when replacing the defective or worn out pulley block or cord. Because of this, the twisted pulley blocks and crossed pulley cords will be the cause of a poor formation of the shed and of an untimely rupture of pulley cords and/or pulley blocks.

In order to avoid this twisting of the pulley blocks and the crossing of the pulley cords, a device is described in patent EP 0 839 937, in which partitions have been provided between the rows of hooks in order to protect the pulley blocks from getting twisted and the pulley cords from getting crossed. The partitions comprise a groove in which the pulley blocks are guided. Successive partitions with intermediate pulley block systems, hooks and selection elements are combined into one module.

The disadvantage of this device is, that the pulley blocks will become inaccessible because of the installation of the partitions and that the modules have to be taken away as a whole and have to be replaced at each problem or fault. Such modules are also expensive to be manufactured.

Another method to prevent the pulley blocks from twisting and the pulley cords from getting crossed consists in using tackles as represented in BE 9200461, where the pulley blocks have been provided with an elongated pulley block guiding groove, which is used to run a guiding spindle through these grooves of the various pulley blocks, the grooves of which are lying next to one another.

When replacing the pulley cords and pulley blocks, in this manner the risk is indeed eliminated that the adjacent pulley blocks will be twisted or the pulley cords will get crossed, but the disadvantage of this system is that the minimum length of the pulley block guiding groove in which the guiding spindle is moving when taking up different positions, has to be at least the length of the stroke of the pulley block so that the pulley block, in its different positions which it has to take up, will not collide with the non-moving guiding spindle. The guiding length lies between two successive pulley wheels and pulley cords and is the direct cause for an increase in installation height of the Jacquard machine.

In EP 0 839 937 a solution is suggested in which the pulley block guiding groove in the pulley block will serve as a guide for a second pulley block. Because of this the installation height of the device will be reduced and the installation will become more compact, particularly when using the pulley block guiding groove for the motion of the second pulley block, but the above-mentioned problem of the pulley blocks getting twisted and the pulley cords getting crossed will not be resolved by this method. If however, in this design, a pulley block guide to prevent the pulley blocks from getting twisted and the pulley cords from getting entangled, has to be realized, then the pulley block guiding groove has to be prolonged for the length of the stroke of the pulley block having a pulley block guiding groove, and a guiding spindle is installed through these grooves, because of which, in this manner, the same disadvantage occurs that the height of the Jacquard weaving machine is increased.

In many Jacquard applications, a pulley block guide in order to prevent the pulley blocks from getting twisted and the pulley cords from getting crossed, is important and necessary, but it will have the disadvantage that it will be the direct cause of a more expensive and a less maintenance friendly design or of an increase of the height of the Jacquard weaving machine. Considering the permanent tendency towards more closely woven fabrics, a higher Jacquard capacity is permanently required, whereas this higher Jacquard capacity on one and the same machine will cause the height of the Jacquard weaving machine to be increased continuously, which may cause problems with respect to the building height of a building in which such a Jacquard weaving machine has to be installed.

SUMMARY OF THE INVENTION

The purpose of the invention therefore is to provide a device for attaching and guiding one or several pulley cords of a Jacquard machine, comprising one or several pulley blocks, each pulley block being provided with at least two pulley wheels, around which one or several pulley cords are passed and being provided with one or several pulley blocks guiding grooves for guiding one or several guiding elements which are provided in order to maintain the exact position of the one or several pulley blocks, thus preventing or limiting the pulley blocks from getting twisted and the pulley cords from getting crossed and at the same time limiting the installation height of the Jacquard weaving machine. It is at the same time likewise a purpose of the invention to provide a device according to the invention which is designed in a cost saving and maintenance friendly manner.

The purpose of the invention is achieved by providing a device for attaching and guiding one or several pulley cords of a Jacquard machine, comprising one or several pulley blocks, each pulley block being provided with at least two pulley wheels around which one or several pulley cords are passed and being provided with one or several pulley block guiding grooves for guiding one or several guiding elements which are provided in order to maintain the exact position of the one or several pulley blocks, the said pulley block guiding grooves being provided outside the space between the said pulley wheels.

In a first preferred embodiment of a device according to the invention, the said pulley block guiding grooves are designed having one open end. This has the advantage that in this manner the pulley blocks may be easily installed and removed.

In a second preferred embodiment of a device according to the invention, the said pulley block guiding grooves are of a closed design.

This has the advantage that the pulley blocks will not lose touch with their guidings during operations carried out when checking and replacing pulley cords and pulley blocks.

In a more preferred embodiment of the device according to the invention, the pulley block guiding grooves have been provided with an element for opening and closing the pulley guiding grooves.

In this manner, the pulley blocks may be easily installed and removed and the pulley blocks do not lose contact with their guidings when operations for checking and removing pulley cords and pulley blocks are carried out.

In a preferred embodiment of the device according to the invention, the pulley block is composed of at least two parts which are interconnected between the pulley wheels.

This has the advantage that the efficiency during installation and maintenance of the Jacquard weaving machine is highly improved and a greater flexibility is offered to adapt the Jacquard weaving machines to be equipped with the new pulley block system.

In a specific embodiment of a device according to the invention, the pulley block is provided with a first and a second pulley wheel and provided with a first and a second pulley block guiding groove, the first pulley block guiding groove being provided above the first pulley wheel and the second pulley block guiding groove being provided under the second pulley wheel.

This has the advantage that a still more stable guiding of the pulley block is obtained.

In a preferred embodiment of a device according to the invention, the said guiding elements are guiding spindles, one guiding spindle being provided to guide two or several adjacent pulley blocks.

In order to further clarify the properties of the present invention and to indicate its additional advantages and particulars, a more detailed description of a device for attaching and guiding one or several pulley cords of a Jacquard machine will now follow. It may be obvious that nothing in the following description may be interpreted as a restriction of the protection of the device according to the invention as demanded for in the claims.

In this description, by means of reference numbers, reference is made to the attached drawings in which:

BRIEF DESCRIPTION OF THE DRAWINGS

FIGS. 1, 2 and 3 are representing a schematic side view of the different positions the pulley block system is able to take up according to the state of the art;

FIGS. 4, 5 and 6 are representing a schematic side view of the different positions a pulley block system according to an embodiment of the invention is able to take up;

FIGS. 7 up to and including 12 are representing possible pulley block designs of a pulley block system according to the invention.

DETAILED DESCRIPTION OF THE PREFERRED EMBODIMENTS

A Jacquard machine, as schematically represented in the FIGS. 1 through 6 therefore consists, as mentioned above, of at least two rows of hooks (1, 2) and of at least two blades (3, 4) which each are moving up and down permanently in opposite phase with respect to a row of hooks (1, 2) and which each are able to take along or not the hooks (1, 2). Taking along the hooks (1, 2) or not is controlled by selection elements (not represented in the figures) which, in the upper or the lower position of the hooks (1, 2) of the Jacquard machine (depending on the design) will retain the hooks (1,2) for the duration of one or several cycles. Two hooks (1, 2) situated directly opposite one another which each are moved by a blade, the said blades (3, 4) moving in opposite phase, are constituting a complementary set of hooks (5). The hooks (1, 2) of one or two complementary sets of hooks take up different positions, depending on their being selected or not. By taking up these different positions, because of the operation in conjunction, imposed by their being interconnected, of these hooks (1, 2) with the pulley wheels (6, 7) and with the inversing pulley wheels (8), by means of the pulley cords (9, 10) having been passed around the pulley wheels (6, 7) and the inversing pulley wheels (8) and by means of the pulley cords (9, 10) being connected to one or several warp yarns (not represented in the figures), this through a harness cord (not represented in the figure), these hooks (1,2) working in conjunction with one another, will bring these warp yarns at the height desired for realizing a fabric with a pattern.

In a device for attaching and guiding one or several pulley cords (9, 10) of a Jacquard machine according to the state of the art, as represented in the FIGS. 1 through 3, two pulley wheels (6, 7) are provided in a pulley block (11), an elongated pulley block guiding groove (12) being provided in the space between the pulley wheels (6, 7). In this elongated groove (12) a guiding spindle (13) has been provided, which moves when the hooks (1, 2) are taking up their different positions. When removing defective or worn out or broken pulley cords (9, 10) or pulley blocks (11), this guiding spindle (13) will ensure that the pulley blocks (11) will stay in their places and, therefore, will not get twisted, with respect to the vertical axis, i.e. the direction of the pulley cords (8, 9), and will be unable to cross the pulley cords (9, 10). The guiding spindle (13) is provided extending through the pulley block guiding grooves (12) of adjacent pulley blocks (11).

The elongated pulley block guiding grooves (12) have a length of minimal the length of the stroke of the pulley block (11), so that the pulley block (11), in the various positions it has to take up, should not collide with the non-moving guiding spindle (13). This guiding length is situated between two successive pulley wheels (6, 7) and pulley cords (9, 10) and is the direct cause for an increase of the installation height of the Jacquard weaving machine.

In a device for attaching and guiding one or several pulley cords (9, 10) of a Jacquard machine according to the invention, one or several pulley block guiding grooves have been provided outside the space between the two pulley wheels (6, 7). Here, various pulley block designs are possible. In the FIGS. 4 through 6, a pulley block (15) has been provided in which one pulley block guiding groove is made in the lower pulley wheel (7). Because of this, the height of the groove as a free and non-used height between the two pulley wheels (6, 7) is saved for one thing. The pulley block guiding groove (14) which, here, is situated under the lower pulley wheel (7) gives no cause to additional height because in harness designs it is usual to keep the life of the pulley cords (9, 10) possibly long by choosing the free distance between a pulley wheel (7) and a reversing pulley wheel (8) around which the same pulley cord (10) is passed in such a manner that in consequence of the movements under normal working conditions, each possible part of the pulley cord will get in touch with only one pulley wheel (7) or reversing pulley wheel (8). This means that in this case the reversing pulley wheel (8) is situated at a certain distance with respect to the pulley wheel (7) together with which it is guiding the same pulley cord (10). In the embodiment according to the state of the art, as represented in the FIGS. 1 through 3, this distance amounts at least to H, H being the displacement of the blade.

The pulley block guiding groove (14), as represented in the FIGS. 4 up to and including 6, which is situated under the lower pulley wheel (7) of the pulley block (15), has to guide the pulley block (15) along the maximum displacement of the pulley block (15), in this case H/2. The minimum height of the pulley block guiding groove H/2 is less than the minimum length of the cord between the lower pulley wheel (7) and the next reversing pulley wheel (8), which, in this case is H. This pulley block (15) with pulley block guiding groove (14) may be inserted with a installation height which is less than the one according to the state of the art, as represented in the FIGS. 1 through 3.

In the FIGS. 7 through 12 various embodiments of pulley blocks are represented.

On the one hand, the pulley block guiding grooves 14) may be designed open on one side. It is possible to provide the pulley block guiding groove or grooves (14) in different places, for example in FIG. 7 a pulley block (15) is represented, as used with the device of the FIGS. 4 through 6, one pulley block guiding groove (14) being provided under the lower pulley wheel (7) of the pulley block (15);

in FIG. 10 a pulley block (15) is represented in which one pulley block guiding groove (14) is provided above the upper pulley wheel (6) of the pulley block (15);

in FIG. 11, two pulley block guiding grooves (14*a*, 14*b*) are provided, i.e. a first pulley block guiding groove (14*a*) above the upper pulley wheel (6) and a second pulley block guiding groove (14*b*) under the lower pulley wheel (7). In this manner, an even more stable guiding is obtained.

A pulley block guiding groove (14) which is open on one side has the advantage that the pulley blocks (15) may be easily installed and removed.

On the other hand, the pulley block guiding grooves (14) may be made closed. Here also, the one or several pulley block guiding grooves (14) can be provided both above the upper pulley wheel (6) and under the lower pulley wheel (7).

A closed pulley block guiding groove (14) has the advantage that during operations carried out when checking or replacing cords and pulley blocks, the guiding will be maintained.

In this case, the closed pulley block guiding grooves (14) may be provided with an element (16) for opening and closing, as represented in FIG. 9. Consequently, this embodiment of a pulley block has the advantages of both the closed pulley block design and the pulley block design open on one side.

By bringing one or several pulley block guiding grooves (14) outside the space between the pulley wheels (6, 7) of the pulley block, the pulley block (17) may be, as represented in FIG. 12, composed of two parts (17*a*, 17*b*), detachably interconnected and which may be separated between the pulley wheels (6, 7). This will strongly increase the efficiency during installation and maintenance of a Jacquard weaving machine, and will offer a greater flexibility when adapting the Jacquard weaving machines to be equipped with a new pulley block system.

The invention claimed is:

1. Device for attaching and guiding one or several pulley cords of a Jacquard machine, comprising one or several pulley blocks each pulley block being provided with at least two pulley wheels around which one or several pulley cords are passed and being provided with one or several pulley block guiding grooves for guiding one or several guiding elements which are designed to maintain the exact position of the one or several pulley blocks, wherein the said pulley block guiding grooves have been provided above and below the space between the said pulley wheels.

2. Device for attaching and guiding one or several pulley cords of a Jacquard machine, comprising one or several pulley blocks each pulley block being provided with at least two pulley wheels around which one or several pulley cords are passed and being provided with one or several pulley block guiding grooves for guiding one or several guiding elements which are designed to maintain the exact position of the one or several pulley blocks, wherein the said pulley block guiding grooves have been provided outside the space between the said pulley wheels, wherein the said pulley block guiding grooves are made open on one side.

3. Device according to claim 1, wherein the said pulley block guiding grooves are made closed.

4. Device according to claim 3, wherein the pulley block guiding grooves have been provided with an element for opening and closing the pulley block guiding grooves.

5. Device according to claim 1, wherein the pulley block is composed of at least two parts which are detachably interconnected between the pulley wheels.

6. Device for attaching and guiding one or several pulley cords of a Jacquard machine, comprising one or several pulley blocks each pulley block being provided with at least two pulley wheels around which one or several pulley cords are passed and being provided with one or several pulley block guiding grooves for guiding one or several guiding elements which are designed to maintain the exact position of the one or several pulley blocks, wherein the said pulley block guiding grooves have been provided outside the space between the said pulley wheels, wherein the pulley block has been provided with a first and a second pulley wheel and has been provided with a first and a second pulley block guiding groove the first pulley block guiding groove being provided above the first pulley wheel and the second pulley block guiding groove being provided under the second pulley wheel.

7. Device according to claim 1, wherein the said guiding elements are guiding spindles, one guiding spindle being provided for guiding two or several adjacent pulley blocks.

* * * * *